US005815175A

United States Patent [19]

Seikel

[11] Patent Number: 5,815,175

[45] Date of Patent: Sep. 29, 1998

[54] METHOD AND ARRANGEMENT FOR MONITORING THE FUNCTIONING OF AN INK PRINT HEAD

[75] Inventor: Michael Seikel, Berlin, Germany

[73] Assignee: Francotyp-Postalia AG & Co., Birkenwerder, Germany

[21] Appl. No.: 712,272

[22] Filed: Sep. 11, 1996

[30] Foreign Application Priority Data

Oct. 6, 1995 [DE] Germany ..... 195 37 160.7

[51] Int. Cl.[6] ..... B41J 29/38; B41J 2/195; B41J 29/393; B41J 2/165

[52] U.S. Cl. ..... 349/23; 347/6; 347/7; 347/19

[58] Field of Search ..... 342/23, 19, 65, 342/6, 7

[56] References Cited

U.S. PATENT DOCUMENTS

| | | | |
|---|---|---|---|
| 4,296,418 | 10/1981 | Yamazaki et al. . | |
| 4,323,905 | 4/1982 | Reiberger et al. | 347/19 |
| 4,568,947 | 2/1986 | Regnault . | |
| 4,896,790 | 1/1990 | Gronnevik . | |
| 4,934,846 | 6/1990 | Gilham . | |
| 5,189,442 | 2/1993 | Herbert . | |
| 5,321,436 | 6/1994 | Herbert . | |

FOREIGN PATENT DOCUMENTS

| | | | |
|---|---|---|---|
| 0 257 570 | 3/1988 | European Pat. Off. . | |
| 0444579 | 2/1991 | European Pat. Off. . | |
| 0 589 581 | 3/1994 | European Pat. Off. . | |
| OS 40 23 390 | 1/1992 | Germany . | |
| 2-2011 | 1/1990 | Japan | 347/7 |

OTHER PUBLICATIONS

Patent Abstracts of Japan, vol. 12, No. 475 (M–774)[3322] Dec. 13, 1988, Japanese Application No. 62–30802.

*Primary Examiner*—Benjamin R. Fuller
*Assistant Examiner*—Thien Tran
*Attorney, Agent, or Firm*—Hill & Simpson

[57] ABSTRACT

In a method and arrangement for monitoring the functioning of an ink print head with individual droplet ejection supplied with ink from an ink tank, an enhancement of the function dependability with little outlay is achieved while still permitting a constant monitoring of the functioning of the ink print head with constant precision, regardless of the brightness of the recording medium. Actual ink flow from the ink tank to the ink print head is constantly quantitatively measured and compared to an intended ink flow value that corresponds to the printing commands. The printing mode is interrupted and a cleaning procedure initiated given deviation from a permitted value. The ink flow is also measured during the cleaning procedure and compared to anticipated, stored, empirically determined values. The cleaning procedure is interrupted and an error search initiated given deviations above predetermined thresholds. Otherwise, the printing mode is reassumed after the cleaning procedure. The ink flow measurement is made by a flow-amount meter with an analog-to-digital converter. The measured results are forwarded to an evaluation unit that contains a comparison circuit, a threshold circuit as an well as an a memory for comparison values and thresholds.

6 Claims, 2 Drawing Sheets

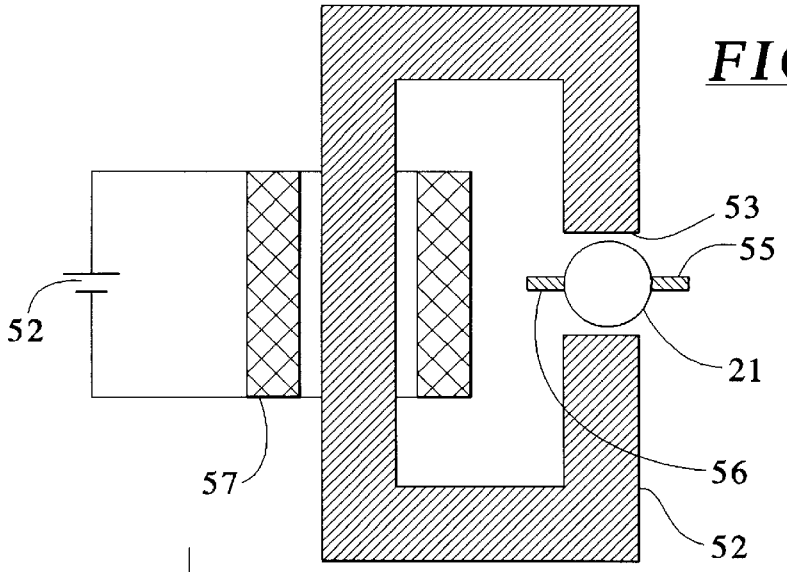
FIG. 4
FIG. 3a
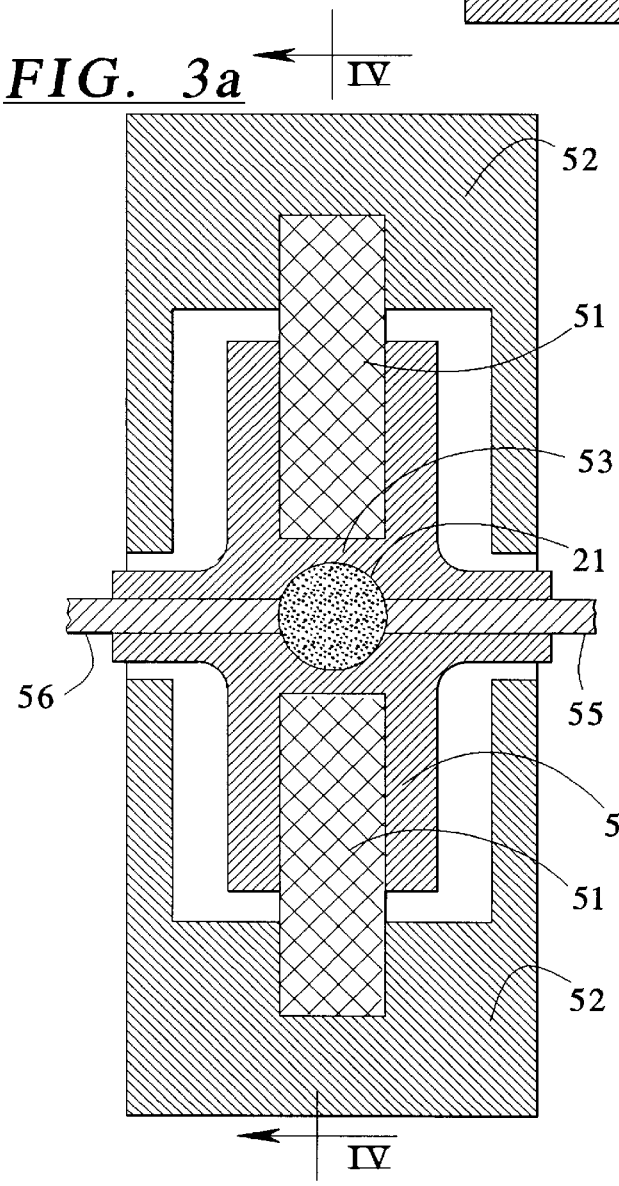
FIG. 3b
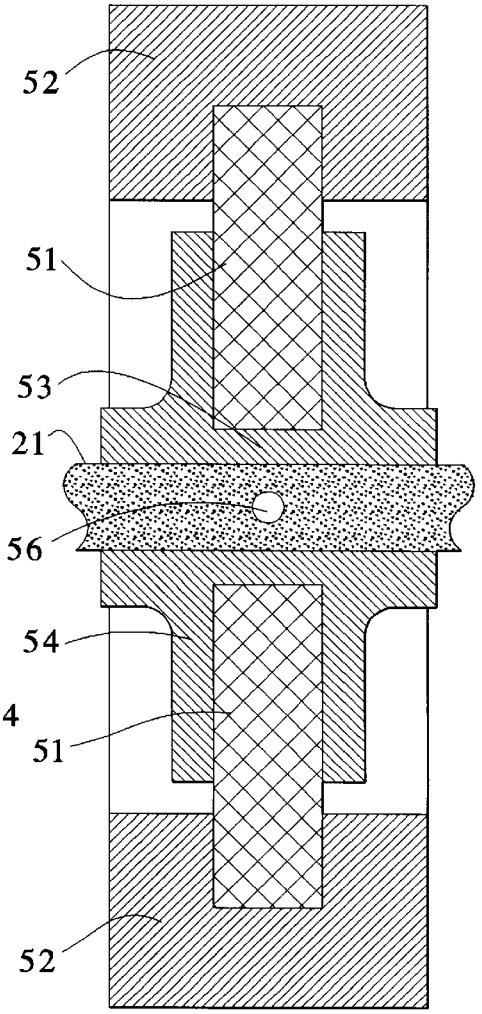

METHOD AND ARRANGEMENT FOR MONITORING THE FUNCTIONING OF AN INK PRINT HEAD

BACKGROUND OF THE INVENTION

1. Field of the Invention

The present invention is directed to a method and to an arrangement for monitoring the functioning of an ink print head.

2. Description of the Prior Art

Ink print heads are utilized in office printers and, recently, in postage meter machines and product labeling devices as well.

Outages of individual nozzles of such an ink print head can arise due to blockage of the nozzle or ink channels with ink particles, blockage of the nozzle apertures with dried ink and/or dust, interruption of the ink capillaries due to the formation of bubbles or rupture of the meniscus, gas inclusions in the ink chamber, or errors in the drive electronics.

These printing outages are not only disturbing in the print image but are critical if they result in a printing error or omission in the case of print format data relevant to the security systems such as value, date, serial number in postage meter machines. A contamination of individual nozzles with dust is possible at any time during operation. When the guidance of the recording medium at the print head ensues such that it is not possible to view it during the printing procedure, there is the risk that, for example, a number of letters may leave the postage meter machine incompletely franked or not franked at all. In addition to the loss of postage, such an uncertainty is highly disadvantageous because the printing events may possibly have to be repeated with new envelopes.

In ink print heads operating according to the bubble jet principle, ink print [or: pressure] chambers with air inclusion can lead to an overheating of and damage to the thermal actuators, since the heat transfer to the ink is then no longer fully assured.

A constant monitoring of the function of the ink print head is therefore important.

It is known from European Application 0 257 570, European Application 0 331 352 and European Application 0 416 849, to drive all print nozzles of an ink print head once per printing pass, so that a line transverse to the feed direction of the mailings arises. Subsequently, this line is sensed with an optical sensor.

Usually, a CCD line sensor is utilized as an optical sensor; since it is typical in such print heads to have, for example, 200 nozzles, the necessity of having a photodiode per nozzle or per printing point, is relatively costly, also see European Application 0 297 810. A constant monitoring is thereby not present. Moreover, the franking imprint on the recording medium ensues with red ink differing greatly in brightness; consequently, the brightness difference between unprinted and printed recording medium can also differ greatly from case to case. Given a dark-colored recording medium, this difference can be so slight that high demands that can hardly be met are made of the optical sensor.

Further, a device for monitoring ink print heads is known, see German OS40 23 390, wherein an ultrasound sensor registers the sound waves emitted during the printing event and supplies them to an evaluation unit as an an electrical signal. The ultrasound sensor in implemented in thin-film technology and is integrated into the layered structure of the ink print head.

Piezosensors, surface filters or polyphenyl films can be employed as an such ultrasound sensors.

The functioning of the individual ink print chamber or nozzle can be determined with this device, but the evaluation unit becomes more extensive and complicated as an the number of ultrasound sensors is decreased, so that it does not fully meet the desire to permit fewer sensors to be used.

SUMMARY OF THE INVENTION

An object of the present invention is to enhance the functional dependability of ink print heads with optimally little outlay.

It is a further object of the present invention to provide a constant monitoring of the functioning of an ink print head, with the brightness of the recording medium having no influence on the monitoring precision or on the testing sensitivity.

The invention proceeds based on the fact that ink from an ink tank can only flow into an ink print head when it is ejected in the printing mode. The quantity of ink contained in an ejected ink droplet and which ink jet has been driven are known, or can be determined. An average value for a franking imprint can be derived therefrom. For example, the amount of ink for an ink droplet can amount to 250 picoliters. Approximately, 40,000 droplets are required per franking imprint, corresponding to a total amount of ink of 10 microliters. A conclusion about the function of the ink print head as an a whole can be derived by comparing the amount of ink which should have been consumed corresponding to the excitation pulses to the amount of ink that has actually flowed into the ink print head.

The inventive solution is also advantageously suited for monitoring the cleaning mode of the ink print head. Analogous to the printing mode, average values for a proper cleaning procedure can also be determined, the flow-through amounts actually measured then being compared thereto.

One condition is to always measure such that the capillary action is not disturbed.

A high-sensitivity sensor with which optimally small flow-through quantities can be measured and that, over and above this, is also as an inexpensive as an possible comes into consideration for measuring the flow-through amount.

An inductive sensor is preferred. A magnetic field is produced therewith in a sensor field of view oriented transversely relative to the ink conduit and the ink is sensed in this region with two electrodes. To this end, the ink must be conductive, or have an aqueous constituent so that ions can form. The ink ions flowing past or through the field of view of the sensor thus generating a weak magnetic field that annularly surrounds the ink conduit. The two magnetic fields superimpose such that the transversely proceeding magnetic field is intensified on the one side of the ink conduit and is weakened on the other side. As an a result thereof, a deflecting force—Lorentz force—acts on the ink ions flowing past, this in turn resulting in an induction voltage. The size of the induction voltage is proportional to the flow-through volume and to the flow-through velocity of the ink.

DESCRIPTION OF THE DRAWINGS

FIG. 3*a* shows an inductive sensor with permanent magnets in accordance with the principles of the present invention in a longitudinal section transverse to the ink conduit.

FIG. 3*b* shows an inductive sensor with permanent magnets in accordance with the principles of the present invention in a longitudinal section AA' along the ink conduit.

FIG. 4 shows an inductive sensor with an electromagnet circuit in accordance with the principles of the present invention, shown in a longitudinal section transverse to the ink conduit.

The illustrations are schematic for simplification and to facilitate understanding.

DESCRIPTION OF THE PREFERRED EMBODIMENTS

Figure 1:
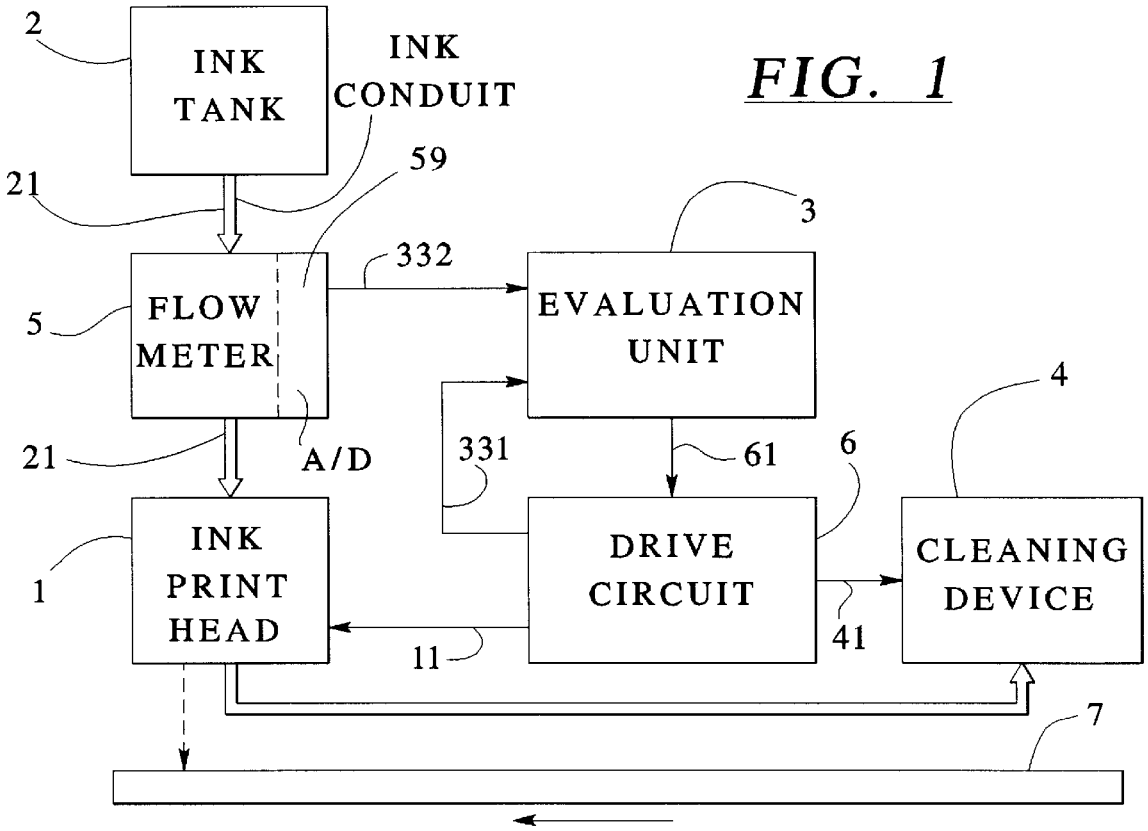
FIG. 1 is a block circuit diagram of an ink print head with monitoring arrangement and cleaning device according to the invention.

As an shown in FIG. 1, an ink conduit 21 is conducted from an ink tank 2, through a meter 5 for the flow-through amount, and to an ink print head 1. A drive circuit 6 for the ink print head 1 has an output side connected to a control input 11 of the ink print head 1 and to a control input 41 of a cleaning device 4.

As an needed, the drive circuit 6 initiates either a printing mode for printing on a moving medium 7, or a cleaning mode.

In the latter case, the cleaning device 4 is mechanically coupled to the ink print head 1 in an expedient way and ink is suctioned out of the ink nozzles. For this purpose, actuators in/at the ink print head 1 can be excited for ink ejection.

The flow-amount meter 5 is provided with an analog-to-digital converter 59 (referred to below as an an A/D converter) that serves the purpose of converting the inducted voltages generated by the ink flow into digital values. The A/D converter 59 can be an integral component or an external component; dependent on which high-sensitivity flow-amount meter 5 is utilized.

Via the A/D converter 59, the output side of the flow-amount meter 5 is connected to an input 332 of an evaluation unit 3. The drive circuit 6 is connected to a second input 331. A first digital value T1 that corresponds to the constantly quantitatively measured, current (actual) ink flow is supplied to the input 332. The minimally measurable value T1 is dependent on the sensitivity of the flow-amount meter 5. A second digital value that corresponds to the constantly counted, current pulses for the excitation of the actuators, i.e., to the ink intended to be ejected is supplied to the input 331. The two values T1 and T2 are compared to one another in the evaluation unit 3. If the result of the comparison exceeds a predetermined, permissible difference, then the evaluation unit 3 supplies a signal to the input 61 of the drive circuit 6 that triggers an interruption of the printing mode and initiation of the cleaning procedure.

Figure 2:
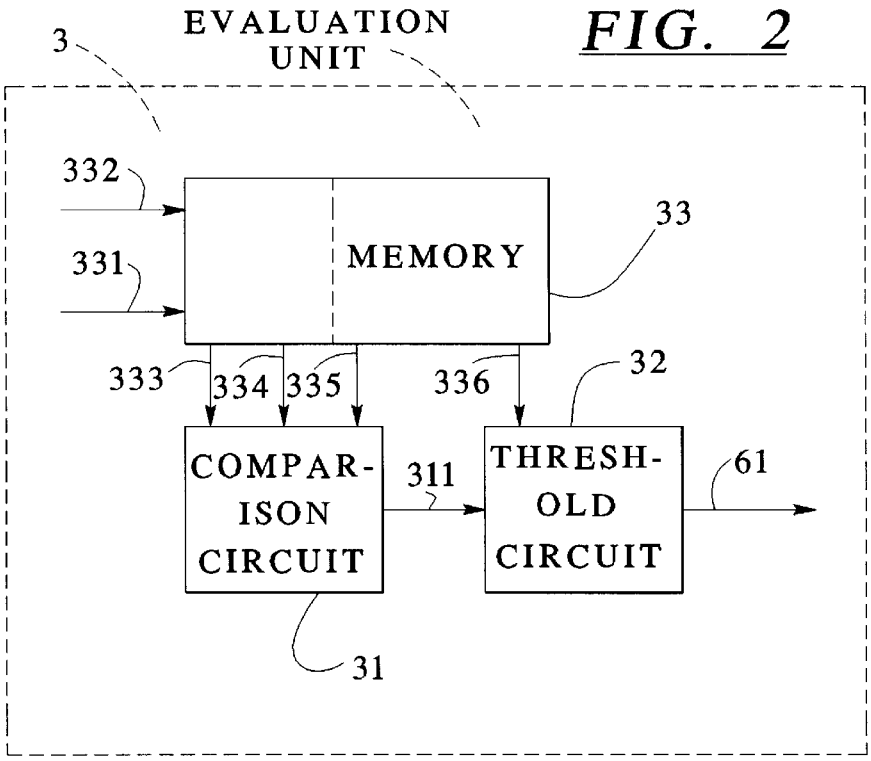
FIG. 2 is a block circuit diagram of an evaluation unit.

As an FIG. 2 shows, the evaluation unit 3 is composed of a comparison circuit 31, a threshold circuit 32 and a memory 33. The first value T1 and the second value T2 are cumulatively intermediately stored in the memory 33. In general, the values T1 and T2 are accumulated for a complete franking impression and are then forwarded to the comparison circuit 31 via the outputs 333 and 334. The two aggregate values are compared to one another by means of a difference and quotient formation and the result is supplied from the output 311 to the threshold circuit 32. A stored, predetermined threshold S that corresponds to a permitted deviation is forwarded from an output 336 of the memory 33 to the threshold circuit 32. Dependent on whether the result of the comparison lies below or above the threshold S, the threshold circuit 32 supplies the input 61 of the drive circuit 6 with a signal to continue printing or to interrupt printing—equivalent to initiating the cleaning procedure.

The thresholds stored in the memory 33 are empirically determined values corresponding to allowed outage rates.

In order to likewise enable a constant monitoring in the cleaning mode, both empirically determined value T3 as an well as an a corresponding threshold S, (which may be) was deposited in the memory 33. The value T3 is forwarded to the comparison circuit 31 via the output 335 in this case.

Dependent on the desired executive plan, conducting the printing and cleaning modes in alternation or a continuation of the cleaning mode or complete interruption for repair purposes can be programmed in the drive circuit 6.

FIG. 3 shows a flow-amount sensor that is implemented as an an inductive sensor. Two permanent magnets 51 are magnetically series-connected at a distance from one another. In the spacing region 53—equivalent to an air gap—, the permanent magnets 51 are mounted in an insulator 54 with their outer ends connected to a soft iron part 52 that closes the magnetic circuit. The insulator 54 has a bore in the spacing region 53 in which the ink conduit is conducted. The ink conduit 21 is arranged such between the permanent magnets 51 such that it orthogonally crosses the magnetic field lines. Two sensor electrodes 55 and 56 are likewise conducted in the insulator 54, these electrodes 55 and 56 extending centrally in the spacing region 53 through the wall of the ink conduit 21 up to the ink, and the electrodes 55 and 56 are thus in contact with the ink, see FIGS. 3*a* and 3*b*. The outer ends of the sensor electrodes 55 and 56 are connected to the inputs of the A/D converter 59 in a way that is not shown.

The insulator 54 can be composed of a plastomer such as an Hostalen. A mumetal is employed for the soft iron part 52.

According to FIG. 4, the flow-amount meter 5 is implemented as an an inductive sensor with a soft iron part 52 surrounded by a coil 57 and having an air gap 53 in which the ink conduit 21 is orthogonally arranged relative to the magnetic field lines. Analogous to FIG. 3, two sensor electrodes 55 and 56 are conducted up to the ink conduit 21, these being in contact with the ink and connected to inputs of the A/D converter 59. The coil 57 is supplied from a d.c. source 58.

Although modifications and changes may be suggested by those skilled in the art, it is the intention of the inventor to embody within the patent warranted hereon all changes and modifications as an reasonably and properly come within the scope of his contribution to the art.

I claim as my invention:

1. A method for monitoring functioning of an ink print head, said ink print head having a plurality of nozzles respectively supplied with ink having a polarizable component, said ink print head ejecting ink droplets from said nozzles, based upon pulsed actuation of actuators respectively allocated to said nozzles each ink droplet containing a known volume of ink, said method comprising the steps of:

continuously monitoring a quantity of ink supplied from an ink source to said ink print head and generating a first running digital value corresponding to said quantity;

exciting respective actuators to eject ink droplets from respective nozzles and counting a number of excitation pulses supplied to said actuators and generating a second running digital value corresponding to said number of pulses;

comparing said first running digital value and said second running digital value and interrupting a printing mode of said print head and initiating a cleaning procedure to clean said nozzles given deviation of said first running digital value and said second running digital value from each other exceeding a predetermined difference;

continuing to generate said first running digital value during said cleaning procedure and evaluating said first running digital value during said cleaning procedure as an indicator of effectiveness of said cleaning procedure;

after said cleaning procedure, re-initiating said printing mode and continuing to generate said first running digital value and said second running digital value starting from a same initial value; and again comparing said first running digital value and said second running digital value and, if a difference between said first running digital value and said second digital value still exceeds said predetermined difference, again interrupting said printing mode.

2. A method as claimed in claim 1 wherein the step of evaluating said first running digital value during said cleaning procedure comprises comparing said first running digital value to at least one empirically determined, stored digital value during said cleaning procedure, and interrupting said cleaning procedure given deviation between said first running digital value and said stored digital value exceeding a predetermined stored threshold.

3. An apparatus for monitoring functioning of an ink print head, said ink print head being supplied with ink from an ink source and ejecting ink droplets from respective nozzles in said ink print head upon pulsed actuation of actuators respectively allocated to said nozzles, each ink droplet containing a known volume of ink and said ink having a polarizable constituent, said apparatus comprising:

a flow meter disposed between said ink source and said ink print head for measuring a quantity of ink flowing between said ink source and said ink print head and generating a first running digital value corresponding to said quantity;

means for counting pulses supplied to said actuators and for generating a running second digital value corresponding to said number of pulses;

a cleaning device which cleans said nozzles in a cleaning procedure;

evaluation means for comparing said first running digital value and said second running digital value and for interrupting a printing mode and initiating said cleaning procedure conducted by said cleaning device if a difference between said first running digital value and said second running digital value exceeds a predetermined difference;

means for storing a third digital value indicative of proper operation of said cleaning device; and said evaluation means further including means for comparing said first running digital value to said third digital value during said cleaning procedure for monitoring operation of said cleaning device and for interrupting said cleaning procedure if said first running digital value and said third digital value deviate more than a predetermined threshold.

4. An apparatus as claimed in claim 3 wherein said flow meter means includes an analog-to-digital converter for converting an analog measurement identifying flow of said ink between said ink source and said ink print head into said first running digital value.

5. An apparatus as claimed in claim 4 wherein said flow meter means comprises an inductive sensor having a magnetic circuit containing at least one permanent magnet and one soft iron part, and said apparatus including an ink conduit for conducting ink from said ink source to said ink print head, said ink conduit being disposed in an air gap of said magnetic circuit transversely relative to magnetic field lines generated by said magnetic circuit, and sensor electrodes in contact with said ink for generating said analog signal.

6. An apparatus as claimed in claim 4 wherein said flow meter means comprises an inductive sensor having an electromagnetic circuit containing a coil and one soft iron part, and said apparatus including an ink conduit for conducting ink from said ink source to said ink print head, said ink conduit being disposed in an air gap of said electromagnetic circuit transversely relative to electromagnetic field lines generated by said electromagnetic circuit, and sensor electrodes in contact with said ink for generating said analog signal.

* * * * *